US007674420B2

(12) United States Patent
Johnson et al.

(10) Patent No.: US 7,674,420 B2
(45) Date of Patent: Mar. 9, 2010

(54) DIMENSIONAL CONTROL OF CONCRETE BLOCKS

(75) Inventors: Paul Joseph Johnson, Clearwater, MN (US); Jimmie L. Mugge, Eagan, MN (US); Paul Randal Tufts, Eagan, MN (US); Ronald J. Scherer, Stillwater, MN (US)

(73) Assignee: Anchor Wall Systems, Inc., Minnetonka, MN (US)

( * ) Notice: Subject to any disclaimer, the term of this patent is extended or adjusted under 35 U.S.C. 154(b) by 460 days.

(21) Appl. No.: 11/195,915

(22) Filed: Aug. 3, 2005

(65) Prior Publication Data

US 2007/0028548 A1 Feb. 8, 2007

(51) Int. Cl.
*B28B 7/10* (2006.01)

(52) U.S. Cl. ..... 264/336; 264/333

(58) Field of Classification Search ..... 52/742.1, 52/742.13, 742.14; 249/102, 112, 119; 264/333, 264/40.1, 334, 336
See application file for complete search history.

(56) References Cited

U.S. PATENT DOCUMENTS

| | | | | |
|---|---|---|---|---|
| 511,098 | A | 12/1893 | Shultz | |
| 813,901 | A | 2/1906 | Leming et al. | |
| 824,235 | A | 6/1906 | Damon | |
| 838,278 | A | 12/1906 | Schwartz | |
| 1,166,312 | A | 12/1915 | Barten | |
| 1,219,127 | A | 3/1917 | Marshall | |
| 1,982,730 | A | 12/1934 | Erkman | |
| 2,038,205 | A | 4/1936 | Case | |
| 2,121,450 | A | 6/1938 | Sentrop | |
| 2,934,807 | A * | 5/1960 | Donati | 264/333 |
| 3,204,316 | A | 9/1965 | Jackson | |
| 3,545,053 | A | 12/1970 | Besser | |
| 3,940,229 | A | 2/1976 | Hutton | |
| 4,218,206 | A | 8/1980 | Mullin | |
| 4,909,970 | A * | 3/1990 | Pardo | 264/40.5 |
| 5,297,772 | A * | 3/1994 | Stefanick | 249/102 |
| 5,445,514 | A * | 8/1995 | Heitz | 425/255 |
| 5,542,837 | A * | 8/1996 | Johnston | 425/183 |
| 5,589,124 | A * | 12/1996 | Woolford et al. | 264/157 |
| 5,879,603 | A * | 3/1999 | Sievert | 264/163 |
| 5,939,104 | A * | 8/1999 | Johnston | 425/356 |

(Continued)

FOREIGN PATENT DOCUMENTS

DE 25 55 714 A1 6/1977

(Continued)

OTHER PUBLICATIONS

Bessert Parts & Equipment Catalog, pp. 5, 18-22.

(Continued)

*Primary Examiner*—Christina Johnson
*Assistant Examiner*—Galen Hauth
(74) *Attorney, Agent, or Firm*—Merchant & Gould P.C.

(57) ABSTRACT

A concrete block mold division plate for front-face-up block molding. The division plate fits into a channel formed in each of the side walls of the mold. A plurality of fasteners secure the division plate within each channel and to the side walls of the mold. The division plate operates in conjunction with an optimized dry cast concrete mixture to provide acceptable control of the flatness and parallelism of the top and bottom surfaces of the blocks.

14 Claims, 6 Drawing Sheets

U.S. PATENT DOCUMENTS

| | | | | |
|---|---|---|---|---|
| 6,007,321 | A * | 12/1999 | Meckel et al. | 425/432 |
| 6,224,815 | B1 * | 5/2001 | LaCroix et al. | 264/333 |
| 6,814,906 | B2 * | 11/2004 | Bergeron et al. | 264/39 |
| 7,208,112 | B2 * | 4/2007 | Scherer | 264/219 |
| 2001/0007380 | A1 * | 7/2001 | LaCroix et al. | 264/333 |
| 2003/0126821 | A1 | 7/2003 | Scherer | |
| 2003/0182011 | A1 | 9/2003 | Scherer | |
| 2004/0004310 | A1 * | 1/2004 | LaCroix et al. | 264/333 |
| 2004/0104511 | A1 * | 6/2004 | Griffith | 264/293 |
| 2006/0273492 | A1 * | 12/2006 | Johnson | 264/333 |

FOREIGN PATENT DOCUMENTS

| | | | |
|---|---|---|---|
| DE | 100 02 390 | A1 | 7/2001 |
| GB | 2 232 114 | A | 12/1990 |
| WO | 03/060251 | A1 | 7/2003 |

OTHER PUBLICATIONS

International Search Report and Written Opinion for PCT/US2006/028712, dated Dec. 28, 2006.

* cited by examiner

DIMENSIONAL CONTROL OF CONCRETE BLOCKS

FIELD OF THE INVENTION

The invention relates generally to the manufacture of concrete blocks. More specifically, the invention relates to dimensional control of the top and bottom surfaces of concrete blocks that are formed front face-up in a mold for use in mortar-less walls.

BACKGROUND OF THE INVENTION

Modern, high speed, automated concrete block plants and concrete paver plants make use of concrete block molds that are open at the top and bottom. These molds are mounted in machines which cyclically station a pallet below the mold to close the bottom of the mold, deliver dry cast concrete into the mold through the open top of the mold, densify and compact the concrete by a combination of vibration and pressure, and strip the uncured blocks from the mold by a relative vertical movement of the mold and the pallet.

For efficient high-volume production, concrete block molds are typically configured to produce multiple blocks simultaneously. A concrete block mold generally comprises side walls and end walls that define the periphery of a mold cavity. Within this mold cavity, division plates may be used to sub-divide the mold cavity into a plurality of block-forming cavities. Further, movable side walls may be used to form the side faces of the block-forming cavity. The division plates are generally rectangular-shaped plates attached to the side walls of the mold. Further, the side walls of the block cavity and the division plates may be covered with replaceable mold face linings to protect the mold components from abrasive wear.

As disclosed in U.S. Published Patent Application 20030182011, some blocks are now being formed with patterned or other processed front faces while retaining the high-speed, mass production of the blocks. As disclosed in U.S. Published Patent Application 20030182011, the blocks can be formed front face-up in the mold, allowing the front face of the block to be contacted by a stripper shoe which imparts a desired three-dimensional pattern to the front face. When a block is formed front-face-up in the mold, the top and bottom surfaces of the blocks (from the perspective of the block as laid in a wall) are formed by division plates. Because the side surfaces of a block must converge to allow the blocks to be laid up in a curved or radiused wall, the front of the block is typically wider than the rear of the block. In order for a block formed front-face-up to be discharged through the bottom of the mold, the side surfaces of a block must be formed by movable side walls that, in a first position during molding, form the wider front portion and narrower bottom portion of the block, and in a second position during discharge of the block from the mold, move sufficiently out of the way for the wider front portion of the block to pass through the bottom of the mold.

A problem that arises when blocks are formed front-face-up in a conventional block mold is that the blocks are prone to being formed with the top and bottom surfaces not being flat and parallel to each other. Since concrete retaining wall blocks are typically assembled without mortar, there is little ability to accommodate variations in the flatness and parallelism of the top and bottom surfaces during the assembly of a wall. It is very important, therefore, that the top and bottom surfaces of the blocks that engage with other blocks be formed as flat as possible and parallel to each other to allow the blocks to lay flat and level on blocks in a lower course of blocks, as well as to allow blocks in an upper course to lay flat and level.

It is also important during the commercial manufacture of concrete blocks that the manufacturing expenses be minimized. Certain components in the concrete mixture are more expensive, such that increasing the percentage of those components in the concrete mixture increases the manufacturing expense. In particular, cementitious materials are a component of a concrete mixture that is typically more expensive than other components. However, the percentage of cementitious materials in the concrete mixture affects the stability and dimensional control of the resulting concrete block. Therefore, it is desired to minimize the amount of cementitious material required in the concrete block mixture while still maintaining acceptable block properties and dimensional control.

Thus, there is a demand for concrete block manufacturing processes that provide for improved control of the flatness and parallelism of the top and bottom surfaces of concrete blocks formed front face-up in a mold, while minimizing the expense of the concrete mixture.

SUMMARY OF THE INVENTION

An improved concrete block manufacturing process provides for improved control of the flatness and parallelism of the top and bottom surfaces of concrete blocks formed front face-up in a mold. The improved manufacturing process incorporates an improved concrete block mold and a modified concrete mixture that operates in cooperation with the concrete block mold. A concrete block mold is provided with a division plate that is secured in the mold in a manner that allows the block to be formed with close control of the top and bottom surfaces. The division plate is secured within channels formed in the side walls of the mold that extend substantially the entire height of the mold cavity so that substantially the entire height of the division plate is secured in the channels, without interfering with the pivoting side wall mechanism. The channels are sized so that there is minimal play between the side edges of the division plate and the channels. A plurality of fasteners secure the division plates to the side walls of the mold. The concrete block mold allows for the use of a concrete mixture with an optimized content of cementitious material, sand, coarse aggregates, and water, where the content of cementitious material is minimized. The concrete mixture is optimized to work in conjunction with the mold, so as to provide a block with sufficient stability prior to being cured that the block adequately retains the geometry formed within the mold.

DETAILED DESCRIPTION OF THE PREFERRED EMBODIMENT

Figure 1:
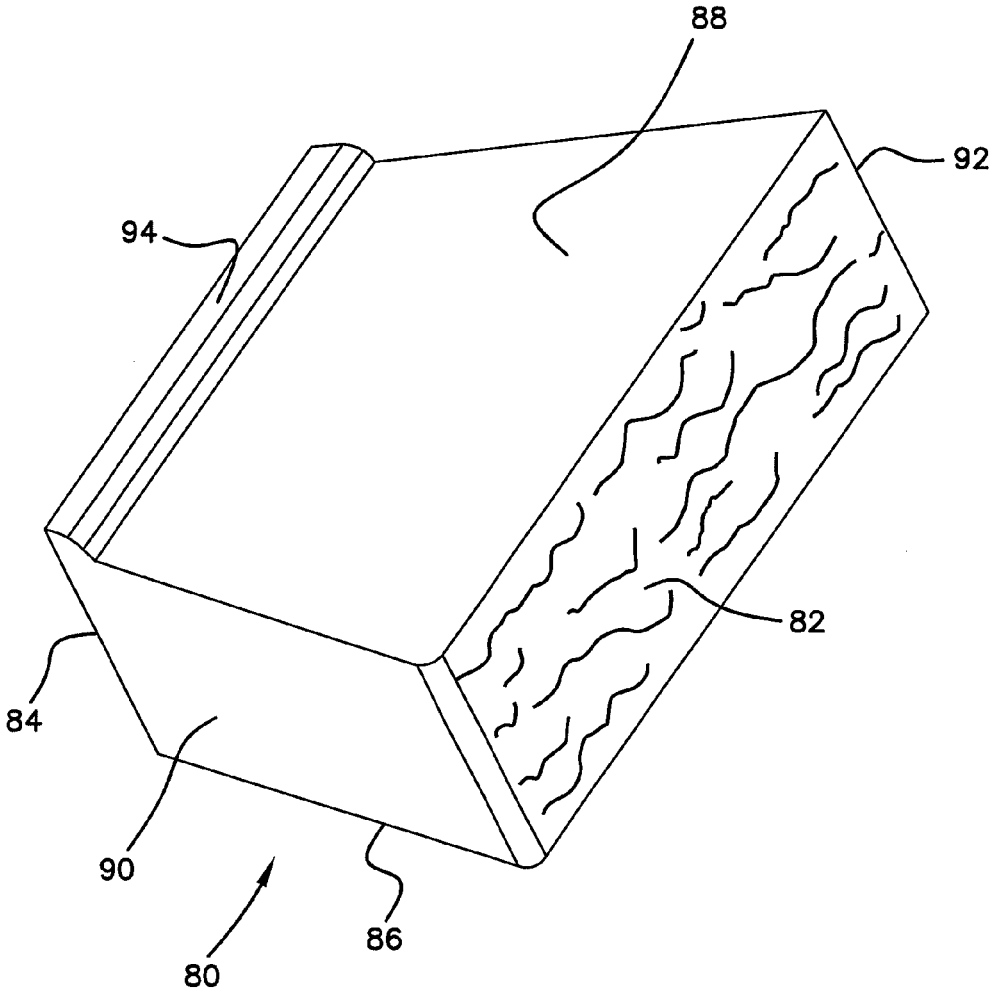
FIG. 1 is a perspective view showing the bottom, front, and one side of a concrete block produced according to the present invention.

The present invention provides a division plate for a concrete block mold. The resulting surface that is shaped by the division plate is substantially flat, which aids in the construction of a high quality wall or other structure made from a plurality of the concrete blocks.

The division plate works in concert with an optimized concrete mixture to provide the desired control of the block geometry. The concrete mixture generally comprises coarse aggregate, sand (also called fine aggregate), cementitious material, colorant (also called pigment), and water. The concrete mixture can be made more stable and self-supporting by increasing the content of coarse aggregate material. However, a greater concentration of coarse aggregate material may prevent the formation of fine detail on the front face of the block, which is often desired when forming blocks front-face-up. Similarly, the concrete mixture can also generally be made more stable by increasing the amount of cementitious material in the concrete mixture, within limits. This helps to prevent the block from slumping after being released from the mold and before being cured. However, cementitious material is relatively expensive and therefore it is desired to keep its use to a minimum. Further, increased percentages of cementitious material may make the concrete mixture stickier, which can prevent the concrete mixture from flowing into the mold properly. The present invention allows the use of a concrete mixture that is optimized for sufficient block stability without unnecessarily increasing the expense of the mixture, making the mixture too sticky to flow into the mold, or preventing the formation of sufficient detail on the front face of the blocks.

The invention will be described with respect to the formation of retaining wall blocks front-face-up in a mold as disclosed in U.S. Published Patent Application 20030182011, which is incorporated herein by reference in its entirety. In such a front-face-up orientation, the top and bottom surfaces of the blocks are formed by division plates (or by one division plate and one end of the mold in the outer cavities of the mold). In addition, the division plate that forms the lower surface of the block may be provided with an undercut at the open bottom of the mold in order to form a locator protrusion, for example a flange, as disclosed in U.S. Published Patent Application 20030182011. However, the inventive concepts could be applied to the formation of other blocks in other orientations.

The formation of blocks with top and bottom surfaces that are not flat and parallel is an especially significant problem because it may prevent the block from laying flat or preventing other blocks from laying flat on the block when laid up in a wall. It has been determined that 1/32 of an inch deviation in flatness and parallelism is a suitable maximum value of deviation. Preferably, the production process results in most blocks having less than 1/32 of an inch deviation in flatness and parallelism and only a few having the maximum of 1/32 of an inch deviation. Although a maximum deviation of less than 1/32 of an inch may be desirable, the additional expense and difficulty of further reducing this deviation may not be justified.

A concrete block produced according to the present invention is illustrated in FIG. 1. The block 80 comprises a block body having a front face 82, a rear face 84, a top face 86, a bottom face 88, and opposed side faces 90, 92. (Note that the terms front, rear, top, bottom, and side faces reference the orientation of the faces of the block as placed within a wall and do not necessarily reflect the orientation of the block as it is produced. Block 80 is shown in FIG. 1 in a generally bottom-face-up orientation to show the features of the block, but such orientation is not representative of the orientation of the block as placed within a wall.) The front face 82 is provided with a predetermined three-dimensional pattern, as described in U.S. Published Patent Application 2003/0182011. The pattern can be decorative. Block 80 also preferably includes a flange 94 that extends below the bottom face 88 of the block. When a retaining wall is constructed using a plurality of blocks 80, flange 94 of a block 80 is designed to abut against the rear face 84 of a block in the course below the block to provide a pre-determined set-back from the course below and to provide course-to-course shear strength.

Figure 2:
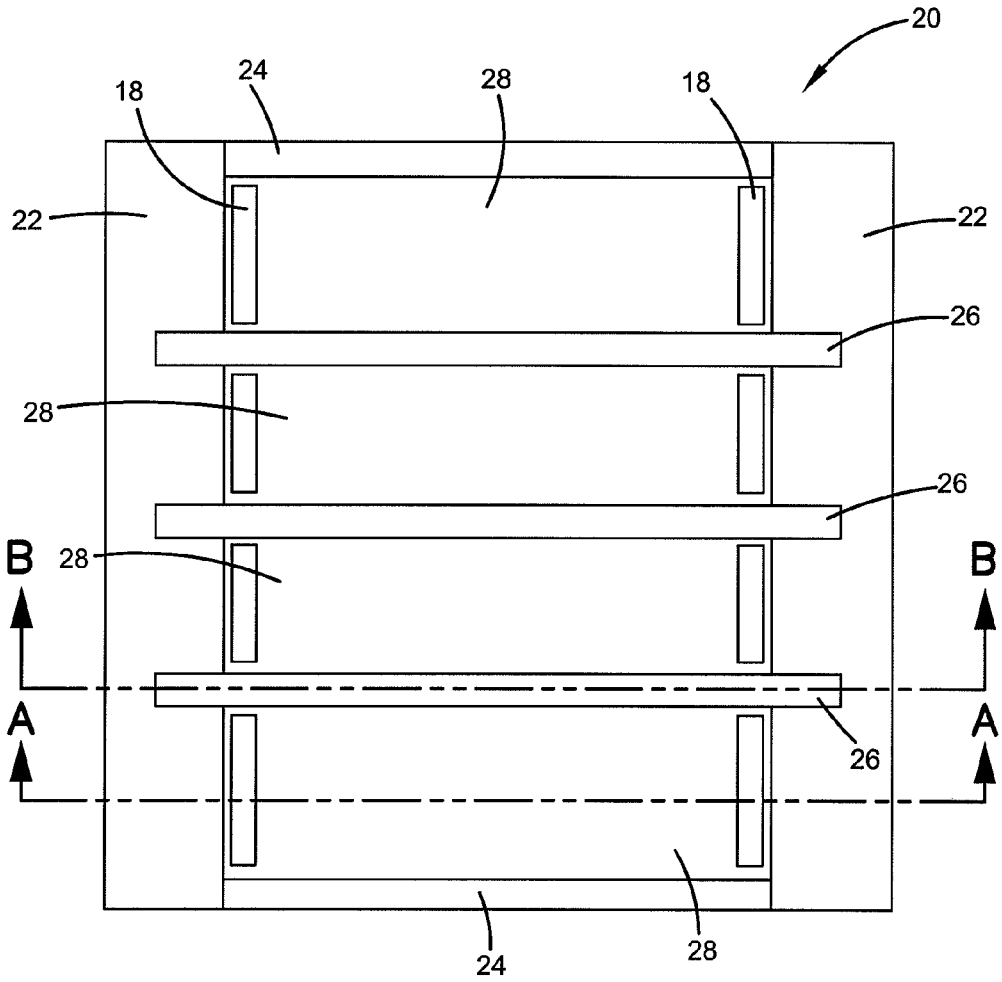
FIG. 2 is a top view of a concrete block mold according to the present invention.

With reference to FIG. 2, a concrete retaining wall block mold 20 is illustrated as comprising a generally rectangular structure defining a mold cavity, where both the top and bottom of the mold cavity are open. The rectangular structure is generally defined by two mold side walls 22 and two mold end walls 24. The mold cavity is further divided into a plurality of individual block-forming cavities 28 by a plurality of division plates 26. Division plates 26 and block cavity movable side walls 18 together define the individual block forming cavities 28 (except at the cavities at the ends of the mold 20, where a mold end wall 24 defines one surface of the individual block-forming cavity). During block formation, the open bottom of the mold and each block-forming cavity 28 is closed by a pallet that is moved into place under the mold 20. The top of the mold is open to allow dry cast concrete to be deposited into the cavities 28, after which stripper shoes connected to a compression head are brought into contact with the concrete within the cavities 28.

Figure 3:
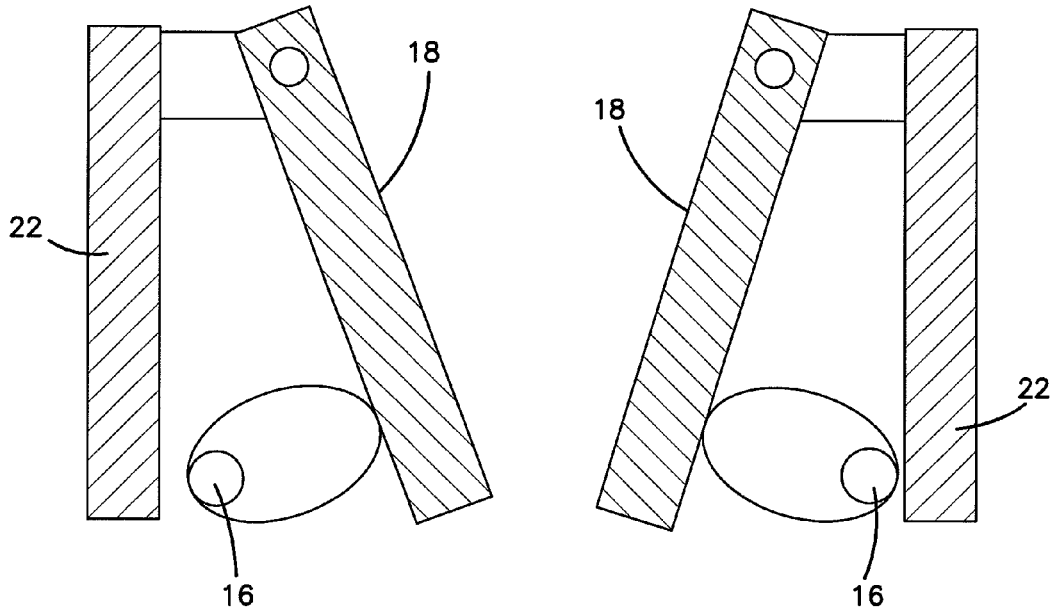
FIG. 3 is a cross-sectional view of the concrete block mold taken along line A-A of FIG. 2.

The mold 20 is constructed so that the blocks are formed front-face-up (i.e. with the front faces facing upward) and the rear faces supported on the pallet positioned underneath the mold 20. Further information on front face-up block formation can be found in U.S. Published Patent Application 2003/0182011. In this orientation, the top and bottom surfaces of the block are formed by two adjacent division plates 26, or by a division plate 26 and a mold end wall 24. Referring to FIG. 3, the side faces of the block are typically formed by movable side walls 18 that, when in a first position during the molding stage, form the converging sides of the block, and when pivoted to a second position during the discharge stage, are retracted to allow the block to be discharged from the bottom of the mold. The position of the block cavity movable side walls 18 may be controlled by a mechanism such as a camshaft 16. However, other devices may be used as disclosed in U.S. Published Patent Application 20030182011. The blocks are discharged through the bottoms of the cavities 28 by relative vertical movement of the pallet and mold 20. The stripper shoes attached to the compression head or head assembly help push the blocks out of the cavities 28. When the shoe including the pattern compacts the concrete used to form the block, the pattern is impressed into the front face of the block. The resulting three-dimensional pattern has a relief, measured from the lowest point to the highest point, preferably of at least about 0.5 inch and more preferably of at least about 1.0 inch.

Oftentimes, the block forming surfaces of the mold cavities 28 are provided with replaceable wear liners that actually contact the concrete in the mold cavities. These liners help prevent wear on the division plates 26, block cavity movable side walls 18, and mold end walls 24, which tend to be expensive to replace. The use of wear liners is known to those having ordinary skill in the art. Therefore, although not illustrated in the drawings, references to the block cavity movable side walls 18, mold end walls 24, and division plates 26 as forming faces of the blocks is meant to include direct formation of the faces by the block cavity movable side walls 18, mold end walls 24, and plates 26, as well as formation of the faces by wear liners attached to the block cavity movable side walls 18, mold end walls 24, and plates 26.

Figure 4:
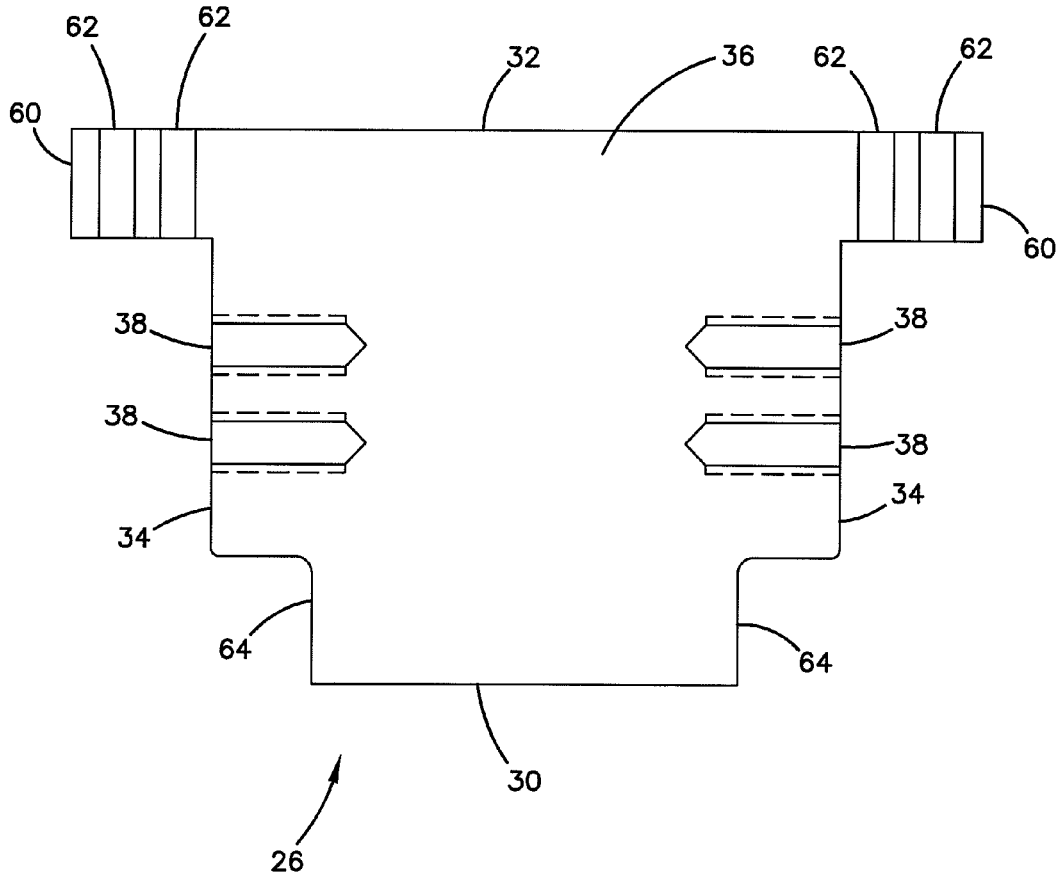
FIG. 4 is a cross-sectional view of a division plate according to the present invention.

Referring to FIG. 4, a division plate 26 according to the present disclosure comprises a plate having a bottom region 30, an upper region 32, side regions 34, and face regions 36. The division plate 26 also comprises a plurality of threaded bolt receiving holes 38 that extend into the division plate through side regions 34. Upper region 32 is characterized by protrusions 60 that extend away from side regions 34 and that typically contain a plurality of bolt clearance holes 62. Bottom region 30 is characterized as having cut-outs 64 along side regions 34 that provide clearance for the mechanism of the movable side wall. Cut-outs 64 are preferably as small as necessary to provide clearance for the movable side wall mechanism and typically constitute about one-quarter of the height of the division plate.

Figure 5:
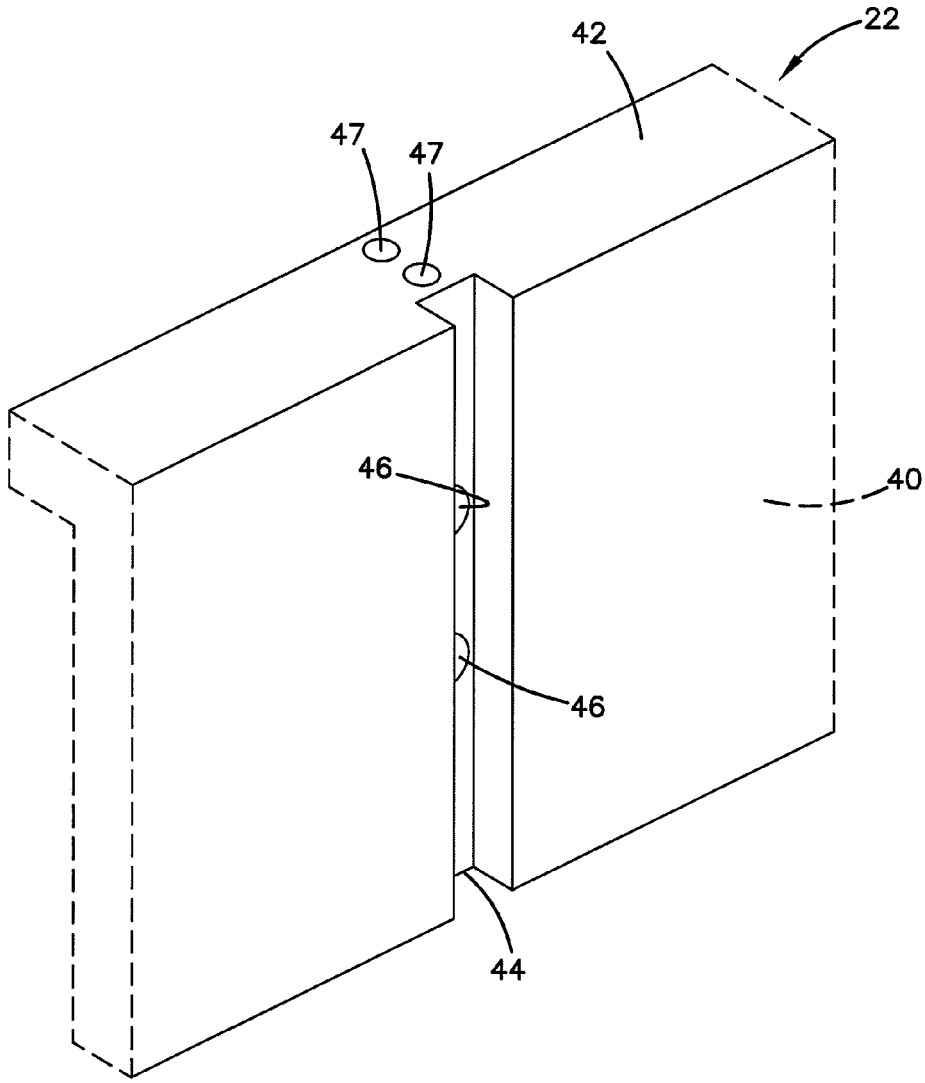
FIG. 5 is a perspective view of a portion of a mold side wall for the concrete block mold of FIG. 2.
Figure 6:
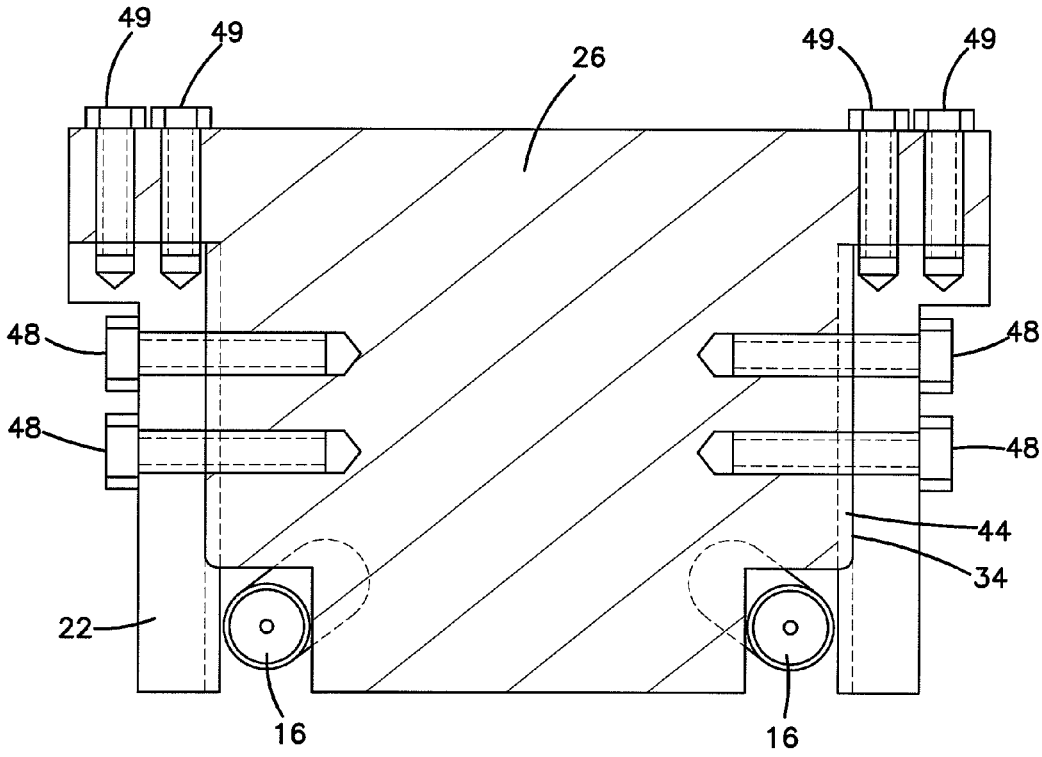
FIG. 6 is a cross-sectional view of a concrete block mold taken along line B-B in FIG. 2.

Referring now to FIG. 5, an embodiment of a segment of one of the mold side walls 22 is shown. The other mold side wall is a mirror image of identical construction. The mold side wall 22 comprises a vertical surface 40 and a horizontal flange 42 protruding away from the mold cavities 28 at the upper region of mold side wall 22. In addition, a channel 44 is formed along the substantial entirety of the height of the vertical surface 40. The channel 44 is configured to receive the edge of the side region 34 of the division plate 26 as shown in FIG. 6. It is very important that each of the channels 44 in the mold side wall 22 be parallel to each other and square to the top and bottom of the mold. The channel 44 is sized to receive the edge 34 of the division plate 26 with minimal play (clearance) between the channel 44 and plate 26 in order to minimize the amount of movement of the plate 26. For example, for a plate 26 having a thickness range, with manufacturing tolerances, of about 1.245 to 1.250 inches (31.623 to 31.750 mm), the channel 44 can have a width range, with manufacturing tolerances, of about 1.250 to 1.258 inches (31.750 to 31.953 mm). The clearance between the plate 26 and the channel 44 can therefore range between about 0.000 to 0.013 inches (0.000 to 0.330 mm). The channel is preferably, with manufacturing tolerances, about 0.307 to 0.312 inches deep (7.80 to 7.92 mm). A plurality of bolt clearance holes 46 extend through mold side wall 22 within channel 44. Also, a plurality of bolt holes 47 extend through horizontal flange 42.

FIG. 6 shows a cross section of a division plate 26 assembled to the mold side wall 22 within the mold 20, taken along line B-B in FIG. 2. The edges 34 of the division plate 26 are disposed in close fitting relation with the channels 44 in the mold side wall 22. Bolts 48 that extend through the bolt holes 38 and bolt holes 46 further secure the division plate 26 to the mold side wall 22. Additionally, bolts 49 extend through bolt holes 62 and into bolt holes 47 to provide additional securement of the division plate 26 to the mold side wall 22. Accordingly, division plate 26 is rigidly constrained during the block molding operation.

The concrete mixture is also an important part of controlling the dimensions of concrete blocks. In forming blocks from dry-cast concrete, the blocks are formed in a mold, removed from the mold, transported to a storage location, and then cured. Thus, when the blocks are removed from the mold they are not yet cured. It is therefore important that the blocks have sufficient stability and rigidity that they can support their own weight until they are cured, without slumping or losing their shape.

A typical concrete mixture comprises cementitious material, sand, coarse aggregates, colorants, and water. Cementitious materials may include such materials as cement, fly ash, slag, silica fume, and other pozzolans, and the methods of properly selecting or combining these constituents are known to those of skill in the art. It is possible to increase the stability of the blocks after they are removed from the mold by increasing the size of the coarse aggregates in the concrete mixture or by increasing the percentage of the mixture consisting of coarse aggregates. Coarse aggregates are a collection of rocky materials that have typically been screened or otherwise mechanically separated, such as by a sieve, to produce a coarse aggregate size distribution that comprises material of a maximum size (typically determined by the size of the openings in the screen or sieve) and smaller materials. For example, the coarse aggregate component may comprise a mixture of aggregates with a characteristic size of 3/16 inch or 1/4 inch. Increasing the size of the coarse aggregates or increasing the percentage of the coarse aggregates within the mixture creates a coarser mixture. While a coarser mixture may improve the stability of the block after it is removed from the mold, the coarser mixture may not be desirable because it may prevent the formation of a high level of detail on the front face of the block.

Generally, increasing the content of cementitious material in the mixture will also increase the stability of the blocks after they are removed from the mold. However, at some point, such as about 21 percent cementitious material in the concrete mixture, increasing the amount of cementitious material will not increase the stability of the blocks after they are removed from the mold, and may in fact decrease the stability of the blocks. However, a typical concrete mixture contains around 12 percent cementitious material, such that increases in the amount of cementitious material generally increase the stability of the blocks after they are removed from the mold. Increasing the content of cementitious material in the mixture has the further advantage that it will not limit the amount of detail that can be formed on the front face of the block. However, increasing the content of cementitious material in the mixture will make the mixture more expensive. Additionally, increasing the content of cementitious material will make the mixture stickier, which makes it more difficult to completely and consistently fill the mold cavity. Where greater amounts of cementitious material are used, it may be necessary to add larger amounts of water to the mixture to allow the mixture to flow properly. However, increased quantities of water may tend to reduce the stability of the blocks after they leave the mold. Therefore, determination of the mixture composition is both difficult and critical.

The mold with the division plates of the present invention allows the blocks to be suitably formed with an acceptable concrete mixture. The inventors have determined that the following concrete mixture yields good results when used in conjunction with the mold and division plates of the present disclosure:

| Component | Weight (dry) | Percentage of total |
|---|---|---|
| Coarse aggregate (3/16 inch) | 458 lbs. | 9.0% |
| Sand | 3,642 lbs. | 71.5% |
| Cementitious material | 700 lbs. | 13.7% |
| Colorant | 36 lbs. | 0.7% |
| Water | 261 lbs. | 5.1% |
| Total for Batch | 5097 lbs. | 100% |

It is generally desired to minimize the content of cementitious material in order to minimize costs. A cementitious material content of about 13.5 percent is the minimum that will function properly in accordance with the present disclosure. Although it is generally desirable to use the minimum content of cementitious material, a cementitious material content of 15 percent will still yield acceptable results.

A typical concrete mixture for blocks formed conventionally according to methods known to those of skill in the art may contain around 12 percent cementitious material. When blocks are formed front-face-up according to the methods described in U.S. Published Patent Application 20030182011, they are more prone to having excessive deviations of the upper and lower face flatness, and as such, may require greater amounts of cementitous material to yield acceptable properties when used with molds with standard division plates. However, the use of the division plates of the present invention allows the use of an optimized concrete mixture with only about 13.5 to 15 percent cementitious material while maintaining adequate block geometry. Thus, the division plates of the present invention allow for a substantial reduction in cementitious material content in the concrete mixture, and thereby results in substantial cost savings.

What is claimed is:

1. A process for manufacturing concrete wall blocks front face up; the wall blocks, with respect to orientation in a wall, having the front face molded with a predetermined three-dimensional pattern, an opposite rear face, top and bottom opposite faces extending between the front and rear faces, and side faces extending between the front and rear faces and the top and bottom faces; the process comprising the steps of:

molding a concrete wall block by depositing a dry cast concrete mixture into a mold, the mold being positioned upright and having two parallel mold sidewalls and two mold end walls perpendicular to the two mold sidewalls; the upright mold having an open top and an open bottom; the upright mold being positioned on a pallet so that the open bottom is closed by the pallet;

forming the concrete wall block side faces by compacting the dry cast concrete mixture against the mold sidewalls;

forming the concrete wall block rear face by compacting the dry cast concrete mixture against the pallet;

forming one of the concrete wall block top or bottom face by compacting the dry cast concrete mixture against a face region of a first division plate that is rigidly constrained during operation of the process; the division plate having side edges;

the side edges of the first division plate being rigidly constrained within a channel in each of the mold sidewalls; the channels being parallel to each other and generally perpendicular to the open top and open bottom of the mold;

the first division plate being rigidly constrained by securing each of the side edges to each of the mold sidewalls at a plurality of separate locations by a bolt at each of the plurality of separate locations, each bolt extending through a mold sidewall and being threaded into a side edge of the first division plate;

forming the other top or bottom face of the concrete wall block by compacting the dry cast concrete mixture against a face region of a wall or plate that is opposite to the first division plate;

forming the concrete wall block front face by compacting the dry cast concrete mixture with a stripper shoe in the open top of the mold to impart a predetermined three-dimensional pattern to the concrete wall block front face; the predetermined three-dimensional pattern having a relief of at least about 0.5 inch;

stripping the concrete wall block from the open bottom of the mold onto the pallet; and curing the concrete wall block to result in a cured concrete wall block.

2. The process of claim 1 wherein:

the step of forming one of the concrete wall block top or bottom face includes compacting the dry cast concrete mixture against a face region of a first division plate in which the clearance between the side edges of the first division plate and each of the channels is no greater than 0.013 inches.

3. The process of claim 1 wherein:

the step of forming the other top or bottom face of the concrete wall block includes compacting the dry cast concrete mixture against a face region of a second division plate that is opposite the first division plate; the second division plate having side edges and being rigidly constrained by a channel in each of the mold sidewalls holding the side edges of the second division plate; each of the channels being parallel to each other and generally perpendicular to the open top and open bottom of the mold; the second division plate being rigidly constrained by securing each of the side edges of second division plate to each of the mold sidewalls at a plurality of separate locations.

4. The process of claim 1 wherein the step of molding a concrete wall block by depositing a dry cast concrete mixture into a mold includes depositing a dry cast concrete mixture that comprises about 13.5 to 21.0 percent cementitious material.

5. The process of claim 1 wherein:

the first division plate has protrusions extending away from the side edges; the protrusions having a plurality of bolt holes; the side edges having a plurality of bolt holes;

the two mold side walls each having a vertical surface and a horizontal flange at an upper region of the mold side walls; the vertical surface of each mold side wall defining the channels; the horizontal flange of each of the mold side walls having a plurality of bolt holes, and the channels of each mold side wall having a plurality of bolt holes;

the step of forming one of the concrete wall block top or bottom face includes compacting the dry cast concrete mixture against a face region of a first division plate that is rigidly constrained by: (i) the plurality of bolts extending through the bolt holes of the mold side wall channels and the bolt holes in the side edges of the first division plate; and (ii) a plurality of bolts extending through the bolt holes of each of the mold side walls horizontal flange and the bolt holes of the first division plate protrusions.

6. The process of claim 1 wherein the cured concrete block has a top and bottom face that have less than 1/32 of an inch deviation in flatness and parallelism.

7. The process of claim 1 wherein the block is a retaining wall block.

8. A process for manufacturing concrete wall blocks front face up; the wall blocks, with respect to orientation in a wall, having the front face molded with a predetermined three-dimensional pattern, an opposite rear face, top and bottom opposite faces extending between the front and rear faces, and side faces extending between the front and rear faces and the top and bottom faces; the process comprising the steps of:

molding a concrete wall block by depositing a dry cast concrete mixture that comprises at least about 13.5 percent cementitious material into a mold, the mold being positioned upright and having two parallel mold sidewalls and two mold end walls perpendicular to the two mold sidewalls; the upright mold having an open top and an open bottom; the upright mold being positioned on a pallet so that the open bottom is closed by the pallet;

forming the concrete wall block side faces by compacting the dry cast concrete mixture against the mold sidewalls;

forming the concrete wall block rear face by compacting the dry cast concrete mixture against the pallet;

forming one of the concrete wall block top or bottom face by compacting the dry cast concrete mixture against a face region of a first division plate that is rigidly constrained during operation of the process; the division plate having side edges;

the side edges of the first division plate being rigidly constrained within a channel in each of the mold sidewalls; the channels being parallel to each other and generally perpendicular to the open top and open bottom of the mold;

the first division plate being rigidly constrained by securing each of the side edges to each of the mold sidewalls at a plurality of separate locations by a bolt at each of the plurality of separate locations, each bolt extending through a mold sidewall and being threaded into a side edge of the first division plate;

forming the other top or bottom face of the concrete wall block by compacting the dry cast concrete mixture against a face region of a wall or plate that is opposite to the first division plate;

forming the concrete wall block front face by compacting the dry cast concrete mixture with a stripper shoe in the open top of the mold to impart a predetermined three-dimensional pattern to the concrete wall block front face; the predetermined three-dimensional pattern having a relief of at least about 0.5 inch;

stripping the concrete wall block from the open bottom of the mold onto the pallet; and curing the concrete wall block to result in a cured concrete wall block.

9. The process of claim 8 wherein:

the step of forming one of the concrete wall block top or bottom face includes compacting the dry cast concrete mixture against a face region of a first division plate in which the clearance between the side edges of the first division plate and each of the channels is no greater than 0.013 inches.

10. The process of claim 8 wherein:

the step of forming the other top or bottom face of the concrete wall block includes compacting the dry cast concrete mixture against a face region of a second division plate that is opposite the first division plate; the second division plate having side edges and being rigidly constrained by a channel in each of the mold sidewalls holding the side edges of the second division plate; each of the channels being parallel to each other and generally perpendicular to the open top and open bottom of the mold; the second division plate being rigidly constrained by securing each of the side edges of second division plate to each of the mold sidewalls at a plurality of separate locations.

11. The process of claim 8 wherein:

the first division plate has protrusions extending away from the side edges; the protrusions having a plurality of bolt holes; the side edges having a plurality of bolt holes;

the two mold side walls each having a vertical surface and a horizontal flange at an upper region of the mold side walls; the vertical surface of each mold side wall defining the channels; the horizontal flange of each of the mold side walls having a plurality of bolt holes, and the channels of each mold side wall having a plurality of bolt holes;

the step of forming one of the concrete wall block top or bottom face includes compacting the dry cast concrete mixture against a face region of a first division plate that is rigidly constrained by: (i) the plurality of bolts extending through the bolt holes of the mold side wall channels and the bolt holes in the side edges of the first division plate; and (ii) a plurality of bolts extending through the bolt holes of each of the mold side walls horizontal flange and the bolt holes of the first division plate protrusions.

12. The process of claim 8 wherein the cured concrete block has a top and bottom face that have less than 1/32 of an inch deviation in flatness and parallelism.

13. The process of claim 12 wherein the step of molding a concrete wall block by depositing a dry cast concrete mixture that comprises at least about 13.5 percent cementitious material into a mold includes depositing a dry cast concrete mixture that comprises about 13.5 to 21.0 percent cementitious material.

14. The process of claim 8 wherein the block is a retaining wall block.

* * * * *